US009243468B2

(12) United States Patent
Yee

(10) Patent No.: US 9,243,468 B2
(45) Date of Patent: Jan. 26, 2016

(54) EXPANDABLE ANNULAR ISOLATOR

(75) Inventor: Chee K. Yee, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 852 days.

(21) Appl. No.: 13/448,552

(22) Filed: Apr. 17, 2012

(65) Prior Publication Data

US 2013/0269956 A1 Oct. 17, 2013

(51) Int. Cl.

| | |
|---|---|
| ***E21B 33/122*** | (2006.01) |
| ***E21B 33/00*** | (2006.01) |
| ***E21B 33/12*** | (2006.01) |
| ***E21B 43/10*** | (2006.01) |

(52) U.S. Cl.
CPC ..... *E21B 33/00* (2013.01); *E21B 33/1208* (2013.01); *E21B 43/108* (2013.01)

(58) Field of Classification Search
CPC ..... E21B 33/12; E21B 33/128; E21B 33/122; E21B 33/129; E21B 23/01; E21B 23/06
USPC ..... 166/134, 119, 378, 196, 187, 137, 217, 166/206
See application file for complete search history.

(56) References Cited

U.S. PATENT DOCUMENTS

| | | | | |
|---|---|---|---|---|
| 5,215,145 | A | 6/1993 | Ross | |
| 5,511,620 | A | 4/1996 | Baugh et al. | |
| 5,961,123 | A | 10/1999 | Ingram et al. | |
| 6,497,289 | B1 * | 12/2002 | Cook et al. | 166/380 |
| 6,854,522 | B2 | 2/2005 | Brezinski et al. | |
| 6,959,759 | B2 | 11/2005 | Doane et al. | |
| 7,383,889 | B2 * | 6/2008 | Ring et al. | 166/382 |
| 7,784,797 | B2 | 8/2010 | Baugh et al. | |
| 2002/0121372 | A1 * | 9/2002 | Cook et al. | 166/250.07 |
| 2002/0166668 | A1 | 11/2002 | Metcalfe et al. | |
| 2003/0121558 | A1 * | 7/2003 | Cook et al. | 138/98 |
| 2003/0183395 | A1 | 10/2003 | Jones | |
| 2004/0221996 | A1 * | 11/2004 | Burge | 166/380 |
| 2004/0256115 | A1 | 12/2004 | Vincent et al. | |
| 2008/0149347 | A1 | 6/2008 | Whitsitt | |
| 2010/0314130 | A1 | 12/2010 | Durst et al. | |

OTHER PUBLICATIONS

Weatherford; TruForm Expandable Liner Hanger System Brochure, 2011, 1-13.

* cited by examiner

*Primary Examiner* — William P Neuder
*Assistant Examiner* — Ronald Runyan
(74) *Attorney, Agent, or Firm* — Steve Rosenblatt

(57) ABSTRACT

A tubular has an exterior sealing element disposed in a recess. A swage passes through the tubular to increase its drift dimension from a location above the seal to below the seal. The interior projection that initially defined the exterior wall recess where the seal is located is expanded to the new drift dimension of the balance of the tubular. Extending members that are initially embedded in the seal while extending from the tubular wall that defines the recess move out during the expansion to engage the surrounding tubular to act as extrusion barriers and to aid in the fixation of the seal while being able to penetrate the wall of the surrounding tubular in so doing.

20 Claims, 2 Drawing Sheets

EXPANDABLE ANNULAR ISOLATOR

FIELD OF THE INVENTION

The field of the invention is packers that are actuated by internal mandrel expansion and more particularly where the sealing element is initially disposed in an external mandrel recess with one or more spikes into the sealing element that act to resist extrusion when the packer is set against a surrounding tubular and exposed to differential pressures.

BACKGROUND OF THE INVENTION

In an effort to obtain adequate sealing in an environment where the mandrel for a packer or hanger or other annular seal is to be expanded, there have been a variety of approaches. Some adopt an internally tapered wedge ring that is expanded under compressive stress with a wedge that is driven into it. The ring grows in diameter but its exterior configuration remains the same and the sealing element and spikes extending from the ring move into contact with the surrounding tubular to resist seal extrusion. This design is illustrated in U.S. Pat. No. 7,784,797.

Other designs simply push out a short segment of a tubular string that has a seal and extrusion barriers above and below as shown in U.S. Pat. No. 6,959,759 FIGS. 1 and 2.

Other designs combine expansion with external energizing the sealing element, such as U.S. Pat. No. 6,854,522 FIGS. 17-19.

Ring or spike type extending members that retain the seal in place after set by expansion have been used in U.S. Pat. No. 5,511,620 in FIG. 4. More traditional type of end extrusion barriers that are not in the context of mandrel expansion are located at ends of a compression set sealing element as in U.S. Pat. Nos. 5,215,145 and 5,961,123.

US Publication 2010/0314130 shows in FIGS. 3 and 4 the use of internal inserts 40 somehow assembled in a tubular that is to be expanded only in the regions where there are external seals 34 in a recess built into the wall 36. The swage is somehow mounted in the lower end of the tubular with the swage outside diameter about equal to the drift diameter of the tubular as shown at the bottom of FIG. 3. How the inserts 40 are installed and firmly held in place is not discussed. After expansion the entire pipe has the drift of the expander 46 but only segments of the pipe have been expanded and the initial drift of the pipe has not increased because of the presence of the rings 40 being used under the seals 34 assuming the same drift as the rest of the pipe that is not expanded.

The present invention expands the tubular to increase its drift while the initial exterior recess that hold the seal material are expanded into alignment with the new dimension of the tubular. Rings or spikes that extend generally radially from the recesses before the expansion move radially outwardly with the seal and can penetrate the seal on the way to making contact with the surrounding tubular. The rings or spikes function as extrusion barriers under differential pressure loading after expansion. The rings or spikes can also penetrate the wall of the surrounding tubular for metal to metal sealing or for fixation of the assembly due to the wall penetration of the surrounding tubular. Those skilled in the art will better appreciate additional aspects of the invention from a review of the detailed description of the preferred embodiment and the associated drawings while appreciating that the full scope of the invention is to be determined from the appended claims.

SUMMARY OF THE INVENTION

A tubular has an exterior sealing element disposed in a recess. A swage passes through the tubular to increase its drift dimension from a location above the seal to below the seal. The interior projection that initially defined the exterior wall recess where the seal is located is expanded to the new drift dimension of the balance of the tubular. Extending members that are initially embedded in the seal while extending from the tubular wall that defines the recess move out during the expansion to engage the surrounding tubular to act as extrusion barriers and to aid in the fixation of the seal while being able to penetrate the wall of the surrounding tubular in so doing.

DETAILED DESCRIPTION OF THE PREFERRED EMBODIMENT

Figure 1:
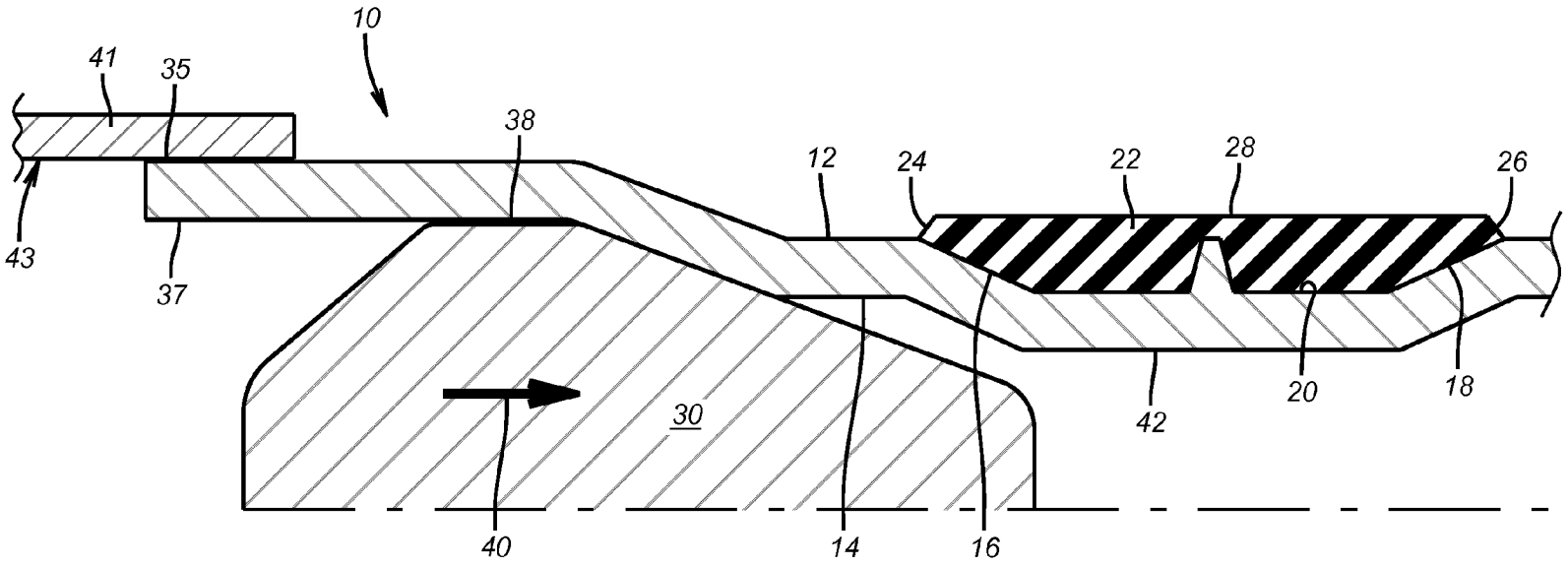
FIG. 1 is a section view of the start of the expansion with the swage reaching the exterior recess where the seal is disposed.

Referring to FIG. 1, a tubular 10 has a pre-expansion outside diameter 12 and a pre-expansion inside diameter 14 with transitions 16 and 18 leading to recessed surface 20. Seal 22 is in contact with surfaces 16, 18 and 20 and extends radially beyond pre-expansion outside diameter 12 due to transition surfaces 24 and 26 that lead to the outer surface 28. Optionally, surface 28 can be even with outside diameter 12 before swage 30 advances beyond the position shown in FIG. 1. The recess defined by surface 20 allows a thicker seal 22 to be used so that in an open hole application with an irregular borehole wall 32 there will be a higher assurance of wall contact and the desired internal pressure in the seal 22 to hold differential pressure in the set position. The surface 20 can be textured to aid bonding of the seal 22 which can also prevent leak paths forming along surface 20.

Seal 22 can be Nitrile rubber or HNBR or Alfas for higher temperature applications. It can swell in certain applications and may be covered with a removable cover to delay the onset of swelling until proper placement is achieved.

Figure 3:
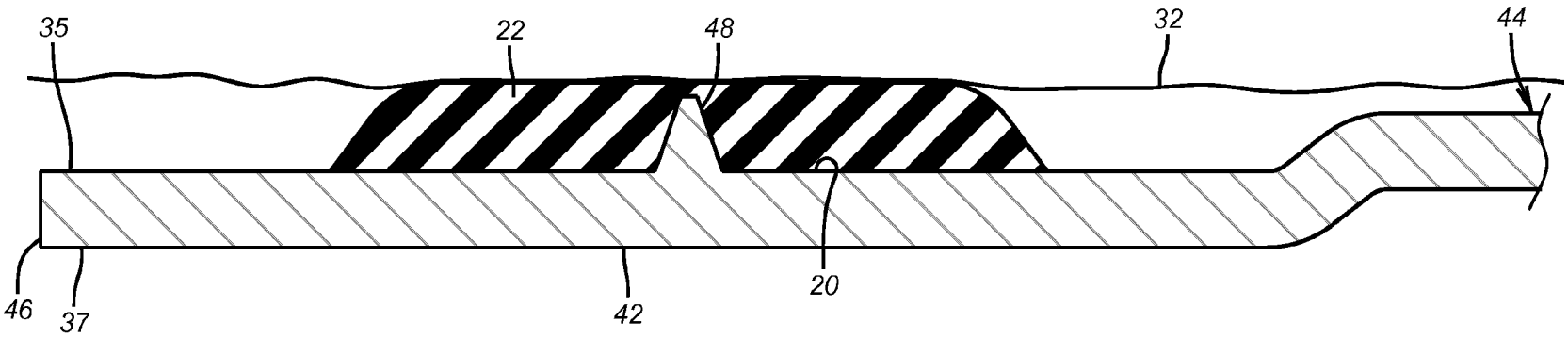
FIG. 3 is the view of FIG. 2 after expansion is completed.

FIG. 1 illustrates that the maximum swaging dimension 38 on the swage 30 produces an external dimension 35 and an internal dimension 37 post expansion. As the swage is moved in the direction of arrow 40 by means known in the art surface 20 will wind up aligned with surface 35 and surface 42 will align with 37 as shown in FIG. 3. Some minor local variations are possible depending on the shape of the borehole surrounding the tubular 10, the nature of the open hole formation at 32 and the material of the tubular 10 as well as the design of the swage 30. The expansion with the swage 30 continues to the lower end of the tubular 10 where a bell 44 can be produced such as by either reconfiguring the swage 30 to a larger dimension or activating a secondary swage with a larger dimension such as the method described in U.S. Pat. No. 7,607,486. For example the swaging can continue in a top down direction through the lower end of the string that includes tubular 10 at which point the swage 30 which can be a variable diameter swage that can be built to more than one swaging dimension is then built to a larger dimension than at surface 42 to form the bell 44 at the lower end. In this manner another string can be added and secured to bell 44 to make a monobore, if desired. The top end 46 can be expanded into a bell 41 on the lower end of the tubular string 43 that is above to gain support for advancement of the swage in a top down direction and for release from a running tool when such support is accomplished, in a manner known in the art. In that manner a monobore completion for the well can be accomplished.

Figure 4:
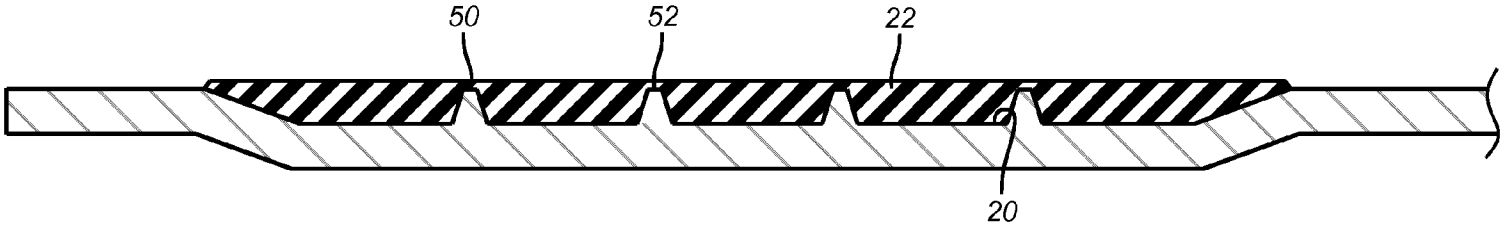
FIG. 4 is an alternative embodiment to FIG. 2 showing multiple rings or spikes within the sealing element.
Figure 2:
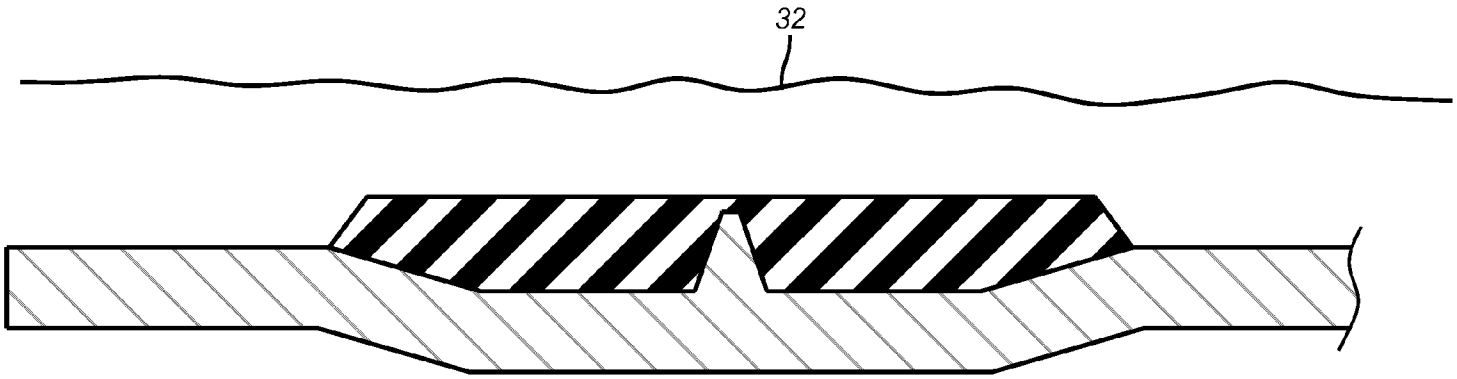
FIG. 2 is a section of the tubular showing the seal before expansion begins.

Extending members 48 can take a wide variety of forms and serve multiple purposes. As shown in FIG. 3 after expansion, the extending members 48 can still be embedded in the seal 22 and out of contact with the borehole wall 32. The expansion of the tubular 10 that schematically represents an entire tubular string with one or more seal assemblies such as 22 can also result in the members 48 breaking through the seal 22 and even embedding themselves in the surrounding open hole 32 or casing or another surrounding tubular that is not shown. The extending members 48 can have textured surfaces or hardened inserts to aid contact or penetration of the surrounding wellbore wall. While the orientation of the members 48 is shown at 90 degrees to the axis of the tubular 10 different orientations are contemplated such as uphole for some and downhole for others. The function of the members 48 can be to resist extrusion of the seal 22 which can for example be a rubber sleeve bonded to the surface 20 and to the exterior surfaces of members 48. Members 48 by penetrating the borehole 32 or the wall of the surrounding tubular that is not shown can also aid in the fixation of the seal 22 and for that matter the entire string of which tubular 10 is a part. Members 48 can be exterior ring structures that are complete or segmented or an array of small pointed projections in parallel rows 50 and 52 as seen in FIG. 4 or even a random distribution from surface 20 that defines the recess in which the seal 22 is disposed.

Those skilled in the art will appreciate that the present invention incorporates one or move seals in an exterior recess in a context where the string is expanded over its length to increase the drift diameter and reduce the size of the surrounding annulus with the seal spanning the annulus to contact an open or cased hole. The seal thickness can be increased due to the recess without adding to the exposure of the seals during run in. The presence of the recess also extends the seal reach as the recess is expanded to the original drift dimension of the string and then beyond as the entire string is further expanded. With the use of a variable swage that can then further expand the lower end of the string to make a bell; a monobore completion can be produced. The top end is initially delivered into position with a running string and an anchor and stroker in a known manner and the upper end can be initially fixed to a bell at a lower end of an existing tubular, at which point the running tool can be released and the assembly of an anchor and stroker can advance with each stroke and expand the tubular with the recess or recesses in the wall in a top down direction. A bottom up expansion can also be accomplished by supporting the string on the swage that is below it with the swage supported on the running string. The swage can then be retained in position as a bell is made at its lower end with the swage then being rebuilt to a smaller expansion dimension for the remainder of the expansion until the overlap to the tubular above is reached and the running string is released.

The seal 22 conforms to the shape of the surrounding borehole or tubular upon expansion for the length of the string in which the tubular 10 is to be found. Members 48 then enhance the performance of the seal 22 in the manner described above. The region of the tubular 10 at the location of the seal 22 is expanded more than the adjacent regions but well within the ability of the tubular to retain its desired pressure rating despite some wall thinning due to the anticipated degree of expansion.

The above description is illustrative of the preferred embodiment and many modifications may be made by those skilled in the art without departing from the invention whose scope is to be determined from the literal and equivalent scope of the claims below:

I claim:

1. A completion method, comprising:

supporting an existing tubular in a wellbore defined by a borehole wall;

delivering an additional tubular, having an initial drift diameter, through said existing tubular and into an overlapping relation with said existing tubular such that a portion of said additional tubular extends beyond a lower end of the existing tubular;

providing at least one external seal in a wall recess of said additional tubular;

extending said at least external seal beyond said recess before expansion;

expanding a substantial length of said additional tubular toward the borehole wall;

engaging said seal to a surrounding open hole for sealing therewith.

2. The method of claim 1, comprising:

eliminating said wall recess due to said expanding.

3. The method of claim 1, comprising:

defining said initial drift diameter in said additional tubular with said wall recess.

4. The method of claim 3, comprising:

expanding the portions of said additional tubular adjacent to said initial drift diameter from an original internal dimension, which is larger than said drift diameter, to a larger dimension.

5. The method of claim 4, comprising:

expanding said original drift diameter to said larger dimension.

6. The method of claim 1, comprising:

expanding a portion of said additional tubular to a larger internal dimension than another portion of said additional tubular.

7. The method of claim 6, comprising:

providing said larger internal dimension at a lower end of said additional tubular.

8. The method of claim 7, comprising:

providing a lower end bell in said existing tubular;

expanding an upper end of said additional tubular into said bell in said existing tubular;

producing a monobore between said existing and additional tubular.

9. A completion method, comprising:

supporting an existing tubular in a wellbore defined by a borehole wall;

delivering an additional tubular, having an initial drift diameter, through said existing tubular and into an overlapping relation with said existing tubular such that a portion of said additional tubular extends beyond a lower end of the existing tubular;

providing at least one external seal in a wall recess of said additional tubular;

expanding a substantial length of said additional tubular toward the borehole wall;

engaging said seal to a surrounding borehole or tubular for sealing therewith;

providing at least one member within said seal and extending from said wall recess.

10. The method of claim 9, comprising:

providing as said at least one member a plurality of members extending generally radially from said wall recess.

11. The method of claim 10, comprising:

making said member in the form of a continuous or discontinuous rings or a series of spikes arranged in rows or randomly arranged in said wall recess.

12. The method of claim 11, comprising:

orienting some of said rings or spikes in an uphole and a downhole direction.

13. The method of claim 11, comprising:

forcing said rings or spikes through said seal as a result of said expanding.

14. The method of claim 11, comprising:

performing said expanding in an uphole or a downhole direction.

15. The method of claim 11, comprising:

using a variable diameter swage for said expanding.

16. A completion method, comprising:

supporting an existing tubular in a wellbore defined by a borehole wall;

delivering an additional tubular, having an initial drift diameter, through said existing tubular and into an overlapping relation with said existing tubular such that a portion of said additional tubular extends beyond a lower end of the existing tubular;

providing at least one external seal in a wall recess of said additional tubular;

expanding a substantial length of said additional tubular toward the borehole wall;

engaging said seal to a surrounding borehole or tubular for sealing therewith;

expanding a portion of said additional tubular to a larger internal dimension than another portion of said additional tubular;

providing said larger internal dimension at a lower end of said additional tubular;

providing a lower end bell in said existing tubular;

expanding an upper end of said additional tubular into said bell in said existing tubular;

producing a monobore between said existing and additional tubular providing at least one member within said seal and extending from said wall recess.

17. The method of claim 16, comprising:

providing as said at least one member a plurality of members extending generally radially from said wall recess.

18. The method of claim 17, comprising:

making said member in the form of a continuous or discontinuous rings or a series of spikes arranged in rows or randomly arranged in said wall recess.

19. The method of claim 17, comprising:

orienting some of said rings or spikes in an uphole and a downhole direction.

20. The method of claim 17, comprising:

forcing said rings or spikes through said seal as a result of said expanding.

* * * * *